US010408513B2

(12) United States Patent
Austin, Jr.

(10) Patent No.: US 10,408,513 B2
(45) Date of Patent: Sep. 10, 2019

(54) OIL LINE CONTROL SYSTEM

(71) Applicant: HEATCRAFT REFRIGERATION PRODUCTS LLC, Richardson, TX (US)

(72) Inventor: Robert H. Austin, Jr., Columbus, GA (US)

(73) Assignee: Heatcraft Refrigeration Products, Inc., Richardson, TX (US)

( * ) Notice: Subject to any disclaimer, the term of this patent is extended or adjusted under 35 U.S.C. 154(b) by 124 days.

(21) Appl. No.: 14/624,612

(22) Filed: Feb. 18, 2015

(65) Prior Publication Data

US 2016/0238293 A1 Aug. 18, 2016

(51) Int. Cl.

| | |
|---|---|
| ***F25B 43/02*** | (2006.01) |
| ***F25B 43/00*** | (2006.01) |
| ***F25B 31/00*** | (2006.01) |
| ***F25B 41/04*** | (2006.01) |

(52) U.S. Cl.

CPC ..... *F25B 43/02* (2013.01); *F25B 31/004* (2013.01); *F25B 41/04* (2013.01); *F25B 41/043* (2013.01); *F25B 43/006* (2013.01); *F25B 2500/28* (2013.01); *F25B 2700/21151* (2013.01)

(58) Field of Classification Search

CPC ..... F25B 43/02; F25B 41/043; F25B 43/006; F25B 31/004; F25B 2700/2105; F25B 2500/28

USPC ..... 62/84

See application file for complete search history.

(56) References Cited

U.S. PATENT DOCUMENTS

| | | | | |
|---|---|---|---|---|
| 3,779,035 | A * | 12/1973 | Kramer | F25B 43/006 62/503 |
| 4,068,493 | A * | 1/1978 | Micai | F25B 43/006 137/172 |
| 4,503,685 | A | 3/1985 | DiCarlo et al. | |
| 4,554,795 | A | 11/1985 | Ibrahim | |
| 4,589,263 | A | 5/1986 | DiCarlo et al. | |
| 4,866,951 | A * | 9/1989 | Masterson, II | F25B 43/006 62/503 |
| 5,327,735 | A * | 7/1994 | Hatton | F25B 45/00 62/292 |
| 5,437,162 | A * | 8/1995 | Eden | F04B 39/0207 62/125 |
| 6,263,694 | B1 * | 7/2001 | Boyko | F25B 31/004 62/195 |
| 2005/0092000 | A1 * | 5/2005 | Hwang | F25B 31/004 62/193 |
| 2005/0252221 | A1 * | 11/2005 | Mizutani | F25B 13/00 62/149 |
| 2006/0196221 | A1 * | 9/2006 | Westermeyer | F25B 43/02 62/470 |

(Continued)

FOREIGN PATENT DOCUMENTS

JP 2001027460 A * 1/2001

*Primary Examiner* — Frantz F Jules
*Assistant Examiner* — Steve S Tanenbaum
(74) *Attorney, Agent, or Firm* — Baker Botts L.L.P.

(57) ABSTRACT

The present application provides a refrigeration system. The refrigeration system may include a suction header, a compressor, a suction header oil return line in communication with the suction header and the compressor, and an oil line control system. The oil line control system may include a sensor and a valve to open and shut the suction header oil return line in response to the sensor.

13 Claims, 2 Drawing Sheets

(56) References Cited

U.S. PATENT DOCUMENTS

2010/0126211 A1* 5/2010 Okamoto ..... F25B 31/004
62/470

* cited by examiner

OIL LINE CONTROL SYSTEM

TECHNICAL FIELD

The present application and the resultant patent relate generally to refrigeration systems and more particularly relate to refrigeration systems including an oil line control system so as to automatically shut off an oil return line when liquid refrigerant floods a suction header and the like so as to prevent compressor damage therein.

BACKGROUND OF THE INVENTION

Modern air conditioning and refrigeration systems provide cooling, ventilation, and humidity control for all or part of a climate controlled area such as a refrigerator, a cooler, a building, and the like. Generally described, a conventional refrigeration cycle includes four basic stages to provide cooling. First, a vapor refrigerant is compressed within one or more compressors at high pressure and high temperature. Second, the compressed vapor is cooled within a condenser by heat exchange with ambient air drawn or blown across a condenser coil by a fan and the like. Third, the liquid refrigerant is passed through an expansion device that reduces both the pressure and the temperature of the liquid refrigerant. The liquid refrigerant is then pumped within the climate controlled area to one or more evaporators. The liquid refrigerant absorbs heat from the surroundings in an evaporator coil as the liquid refrigerant evaporates to a vapor. Finally, the vapor refrigerant returns to the compressor and the cycle repeats. Various alternatives on this basic refrigeration cycle are known and also may be used herein.

Current design trends in refrigeration systems focus on increased efficiency, reduced energy consumption, and other types of environmentally friendly improvements. Similarly, other design goals may focus on reducing the overall complexity and costs typically found in modern refrigeration systems. There is thus a desire for improved refrigeration systems with respect to efficiency, energy usage, complexity, and costs.

SUMMARY OF THE INVENTION

The present application and the resultant patent thus provide a refrigeration system. The refrigeration system may include a suction header, a compressor, a suction header oil return line in communication with the suction header and the compressor, and an oil line control system. The oil line control system may include a sensor and a valve to open and shut the suction header oil return line in response to the sensor. The sensor may be a temperature sensor that detects the presence of a cooler liquid refrigerant therein.

The present application and the resultant patent further provide a method of protecting a compressor from a flow of liquid refrigerant. The method may include the steps of monitoring a temperature of a fluid in an oil return line extending between a suction header and the compressor, determining a temperature drop in the fluid in the oil return line, and closing the oil return line until the temperature of the fluid in the oil return line increases.

The present application and the resultant patent further provide a refrigeration system. The refrigeration system may include a suction header, a compressor, a suction header oil return line in communication with the suction header and the compressor, a temperature sensor positioned about the suction header oil return line, and a valve to open and shut the suction header oil return line in response to the temperature sensor.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
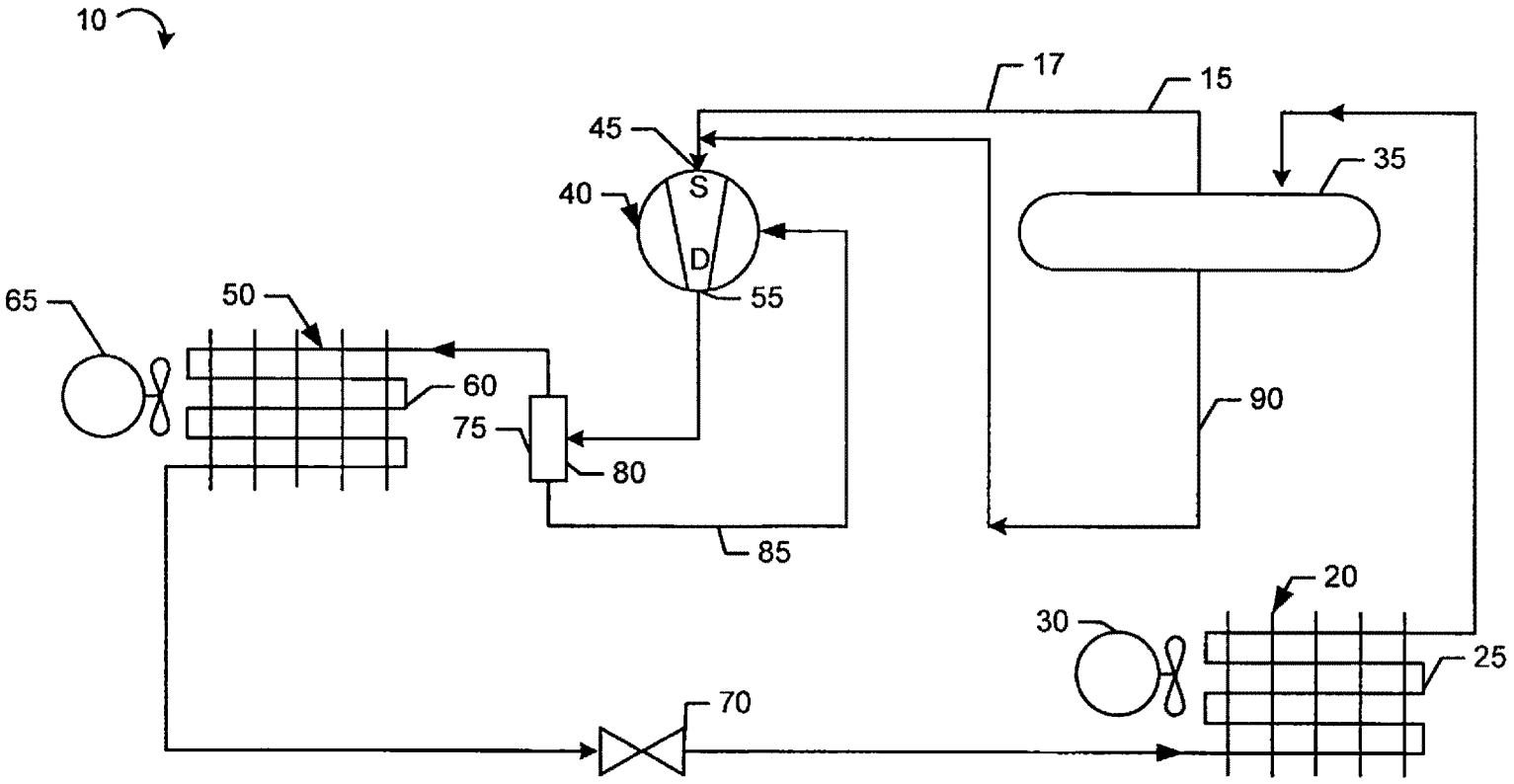
FIG. 1 Prior Art
FIG. 1 is a schematic diagram of a known refrigeration system with an oil return line.

Referring now to the drawings, in which like numerals refer to like elements throughout the several views, FIG. 1 shows an example of known refrigeration system 10. The refrigeration system 10 may be used to cool any type of a climate controlled area or a refrigerated space. The refrigerated space may be a refrigerator, a cooler, a building, and the like. The refrigeration system 10 may include a flow of a refrigerant 15. The refrigerant 15 may include conventional refrigerants such as hydrofluorocarbons, carbon dioxide, ammonia, and the like. Any type of refrigerant may be used herein.

The refrigeration system 10 may include an evaporator assembly 20. The evaporator assembly 20 may include one or more evaporator coils 25 and an evaporator fan 30. The evaporator assembly 20 may be positioned within or adjacent to the refrigerated space to provide cooling therein. The refrigeration system 10 may include a suction header 35. The suction header 35 may store and distribute the refrigerant 15 as required. The suction header 35 may flow the refrigerant 15 to an accumulator or directly to one or more compressors 40 via one or more refrigerant lines 17. Specifically, the suction header 35 may be in communication with a suction port 45 on each compressor 40. The compressors 40 compress the flow of refrigerant 15 and forward the flow to a condenser assembly 50 via a discharge port 55. The condenser assembly 50 may include on or more condenser coils 60 and a condenser fan 65. The condenser fan 65 pulls ambient air over the condenser coils 60 for heat exchange with the refrigerant. The refrigerant 15 then may flow to an expansion valve 70 before being returned to the evaporator assembly 20 so as to repeat the cycle herein. The refrigeration system 10 described herein is for the purpose of example only. Many other types of refrigeration systems, refrigeration cycles, and refrigeration components may be used herein.

The compressors 40 herein may require a source of oil in communication with the flow of the refrigerant 15. An oil separator 75 may be positioned downstream of the compressors 40. Any oil that may be trapped in the refrigerant vapor downstream of the compressors 40 may be removed therein. A removed flow of oil 80 then may be returned to the compressors 40 via an oil return line 85. Moreover, any oil 80 that remains in the flow of the refrigerant 15 may eventually settle within the suction header 35. A suction oil return line 90 thus may return the oil 80 to the compressors 40 or to the refrigeration line 17 upstream of the compressors 40. Other components and other configurations may be used herein.

Figure 2:
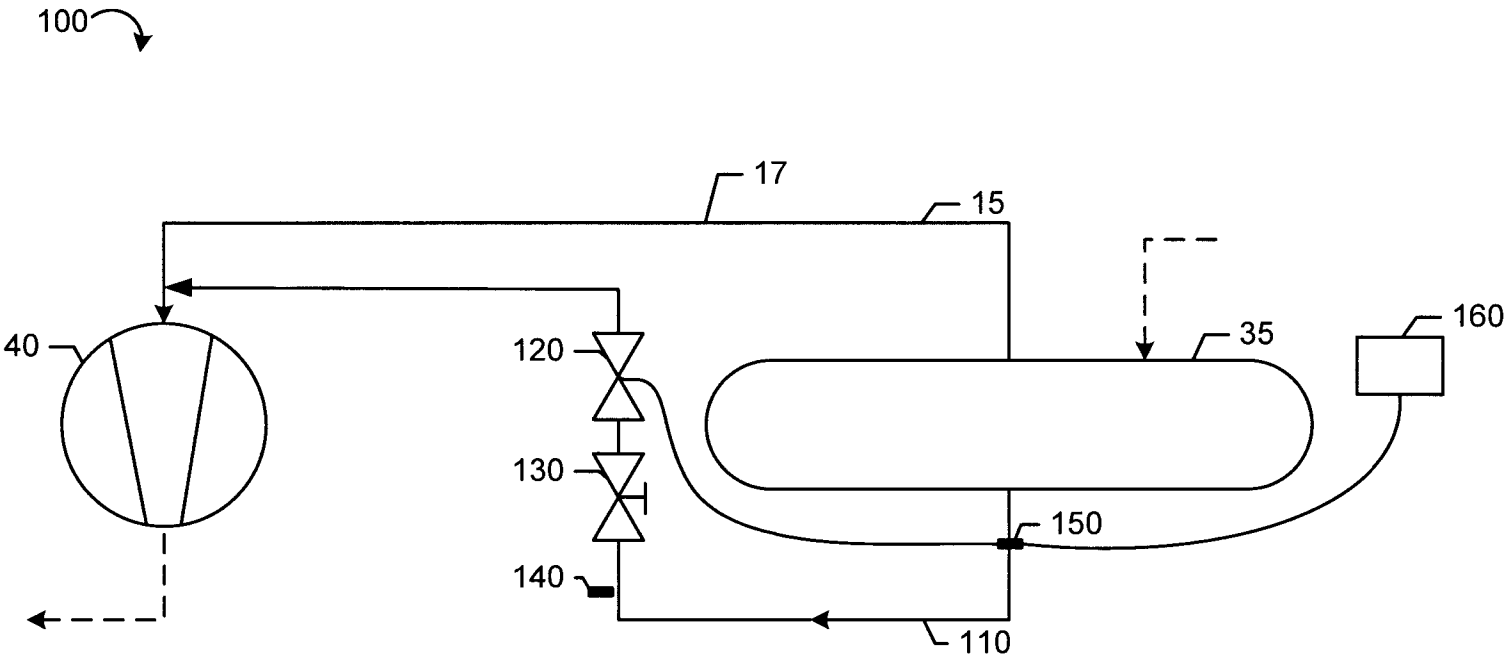
FIG. 2 is a schematic diagram of an oil line control system as may be described herein.

FIG. 2 shows an oil line control system 100 as may be described herein. The oil line control system 100 may include a suction header oil return line 110. The suction header oil return line 110 may extend from the suction header 35 to one or more of the compressors 40 or to the refrigeration line 17 upstream of the compressors. The suction oil return line 110 may include a solenoid valve 120 thereon. The solenoid valve 120 may be a conventional on/off type flow control valve. Other types of flow control valves may be used herein. The solenoid valve 120 normally may be in the open position. The suction header oil return line 110 also may include a ball valve 130 or other type of manual control valve. The ball valve 130 may be manually operated to open and close the suction header oil return line 110 as needed. The suction header oil return line 110 also may include a Schrader valve 140. The Schrader valve 140 may be a conventional pneumatic valve so as to clear the line via air pressure if necessary. Other type of clearing access ports and clearing devices also may be used herein.

The oil line control system 100 also may include a temperature sensor 150. The temperature sensor 150 may be positioned on the suction oil return line 110 or elsewhere to determine the temperature of the refrigerant 15 and/or changes in the temperature of the refrigerant 15. The temperature sensor 150 also may be located inside the suction header 35 or along the exterior thereof. The temperature sensor 150 may be of conventional design. More than one temperature sensor 150 may be used herein. The temperature sensor 150 may be in communication with the solenoid valve 120 and a controller 160. The controller 160 may be any type of programmable logic device. The controller 160 may be local or remote. Other components and other configurations may be used herein.

The oil line control system 100 thus prevents damage to the compressors 40 if liquid refrigerant 15 in the suction header 35 enters the suction header oil return line 110. If the liquid refrigerant 15 enters the suction header oil return line 110, the temperature sensor 150 provides an alarm triggered by a lower than normal temperature therein. A predetermined temperature may be used and/or the temperature may depend upon other types of operational parameters. The solenoid valve 120 thus closes to prevent the liquid refrigerant 15 from flowing to the suction port 45 of the compressor 40. Similarly, the controller 160 may reopen the solenoid valve 120 and the suction header oil return line 110 when the temperature sensor 150 indicates a temperature increase. Such a temperature increase may indicate that the refrigerant 15 has boiled off. Likewise, a predetermined temperature may be used and/or the temperature may depend upon other types of operational parameters. The oil line control system 100 then may return to normal operation. Different types of heating sources, such as an electric heater, a hot gas bypass heater, and the like, also may be employed to assist in boiling off the liquid refrigerant 15 in the suction header 35. Other components and other configurations may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A refrigeration system, comprising:
- a suction header;
- a compressor;
- a suction header oil return line in communication with a refrigerant line upstream of the compressor; and
- an oil line control system, wherein the oil line control system comprises:
  - a temperature sensor operable to detect a temperature in the suction header oil return line,
  - a valve to open and shut the suction header oil return line in response to the temperature sensor,
  - an access port located between the valve and the suction header, the access port operable to clear the suction header oil return line via air pressure, and
  - a heating source operable to boil off liquid refrigerant, and
- a controller coupled to the temperature sensor and the valve, the controller operable to:
  - shut the suction header oil return line when the temperature is less than a first predetermined temperature; and
  - open the suction header oil return line when the temperature is greater than a second predetermined temperature, wherein the first predetermined temperature is different than the second predetermined temperature.

2. The refrigeration system of claim 1, wherein the refrigerant line is in communication with the compressor and the suction header.

3. The refrigeration system of claim 1, wherein the suction header comprises refrigerant therein.

4. The refrigeration system of claim 1, wherein the suction header comprises oil therein.

5. The refrigeration system of claim 1, wherein the valve comprises a solenoid valve.

6. The refrigeration system of claim 1, wherein the oil line control system comprises a manual control valve on the suction header oil return line.

7. The refrigeration system of claim 6, wherein the manual control valve comprises a ball valve.

8. The refrigeration system of claim 1, wherein the access port comprises a pneumatic valve on the suction header oil return line.

9. The refrigeration system of claim 8, wherein the pneumatic valve comprises a Schrader valve.

10. The refrigeration system of claim 1, further comprising an oil separator downstream of the compressor.

11. The refrigeration system of claim 10, further comprising an oil separator return line in communication with the oil separator and the compressor.

12. The refrigeration system of claim 1, further comprising a plurality of compressors.

13. A method of protecting a compressor from a flow of liquid refrigerant, comprising:
- monitoring a temperature of a fluid in an oil return line extending between a suction header and a refrigerant line upstream of the compressor;
- determining a first temperature in the fluid in the oil return line;
- clearing the oil return line with air pressure via an access port located between the valve and the suction header;
- shutting, by a controller, the suction header oil return line when the first temperature is less than a first predetermined temperature;
- determining a second temperature in the fluid in the oil return line; and
- opening, by the controller, the suction header oil return line when the second temperature is greater than a second predetermined temperature, wherein the first predetermined temperature is different than the second predetermined temperature.

* * * * *